US007484512B2

(12) United States Patent
Martinelli et al.

(10) Patent No.: US 7,484,512 B2
(45) Date of Patent: Feb. 3, 2009

(54) HAIR ENHANCING APPARATUS

(76) Inventors: Suzanne Martinelli, 331 Rockmeade Dr., Wilmington, DE (US) 19810; Catherine Lazarczyk, 331 Rockmeade Dr., Wilmington, DE (US) 19810

( * ) Notice: Subject to any disclaimer, the term of this patent is extended or adjusted under 35 U.S.C. 154(b) by 0 days.

(21) Appl. No.: 11/180,902

(22) Filed: Jul. 13, 2005

(65) Prior Publication Data

US 2006/0042644 A1 Mar. 2, 2006

Related U.S. Application Data

(60) Provisional application No. 60/587,628, filed on Jul. 13, 2004.

(51) Int. Cl.
*A41G 5/00* (2006.01)

(52) U.S. Cl. ..... 132/55

(58) Field of Classification Search ..... 132/55, 132/54, 53, 105, 106, 144, 145, 146, 148
See application file for complete search history.

(56) References Cited

U.S. PATENT DOCUMENTS

| | | | | | |
|---|---|---|---|---|---|
| 459,000 | A * | 9/1891 | Emery | 132/105 |
| 756,367 | A * | 4/1904 | Howe | 132/106 |
| 794,479 | A * | 7/1905 | Austin | 132/105 |
| 886,034 | A * | 4/1908 | Bechtold | 132/106 |
| 1,526,440 | A * | 2/1925 | Skaruda | 132/105 |
| 1,595,595 | A * | 8/1926 | Bonat et al. | 132/105 |
| 1,714,358 | A * | 5/1929 | Finkelstein | 132/105 |
| 2,649,763 | A * | 8/1953 | Buergi-Schenk | 132/144 |
| 4,254,783 | A | 3/1981 | Kim | |
| 6,035,861 | A | 3/2000 | Capello | |
| 2005/0263167 | A1 * | 12/2005 | Lee et al. | 132/53 |

* cited by examiner

*Primary Examiner*—Robyn Doan
*Assistant Examiner*—Rachel A Running
(74) *Attorney, Agent, or Firm*—Jeffrey C. Lew

(57) ABSTRACT

A device for propping up hair comprising a bob member for being attached to the back of the hair a comb attached to the bob member for supporting the bob member.

11 Claims, 6 Drawing Sheets

HAIR ENHANCING APPARATUS

CROSS REFERENCE TO RELATED APPLICATIONS

This application claims benefit to provisional application 60/587,628, filed on Jul. 13, 2004, entitled "Improved Hair Bob", which is incorporated by reference herein in its entirety.

FIELD OF THE INVENTION

The present application is directed to hair appearance devices. In particular, the present invention is specifically directed to devices and apparatus, which affect the appearance and enhance the perceived quantity of human hair.

BACKGROUND OF THE INVENTION

The appearance of puffed up or enhanced hair is highly desirable and provides a unique look and feel for any moment. These have typically included hair attachment "falls" and special sprays and chemical treatments. Heretofore, there have been a number of patents related to systems for adding height or fullness to hair.

U.S. Pat. No. 6,035,861, for example, discloses a system for adding height to the hair at the crown of the wearer's head. The system comprises two hair inserts which can be identical to each other. Each insert is formed by attaching a natural-looking hairpiece to the main bar of a comb. The system is inserted by the wearer gathering the natural hair at the crown of her head inserting one insert from each side of the gathered hair, such that the teeth of the combs intermesh, frictionally engaging the system in the wearer's hair. Finally, the wearer's natural hair can be arranged over the inserted hairpieces so that the system is completely hidden from view. The system is typically hidden from view beneath the wearer's natural hair. Moreover, as the system incorporates natural or synthetic hair covering the main bars of the combs, it will not be greatly noticeable or cause embarrassment to the wearer.

U.S. Pat. No. 4,254,783 is directed to a hairpiece having a comb-shaped attaching member designed to provide the most natural appearance while securely attaching the hairpiece to the natural hairpiece of the wearer. In a preferred embodiment, artificial hair root is attached to the comb-shaped member at a plurality of disbursed and disconnected hair root attach sites. These are formed at one side of the comb-shaped member. To provide the desired flexibility, the comb-shaped member may be formed with a spring wire core coated with a thermo plastic material which holds the hair roots.

The prior art is thus replete with hair systems which incorporate combs with added hair or increased thickness and height. These systems are expensive, hot and use chemicals.

There is a long felt need for a device for adding height to hair which can be simple and compact and which can blend in with the natural hair. Such a product would be highly desirable and improve over current systems.

It is an object of the present invention to provide a hair adding system which will puff up and increase the apparent height of the wearer's hair without the use of hair pieces and chemicals.

These and other objects of the present invention will become apparent from the detailed description which follows.

SUMMARY OF THE INVENTION

In accordance with the invention, a device for propping up hair comprising: a bob member for being attached to the back of the hair; a comb affixed to the bob member for supporting the bob member.

In a further embodiment, a device for propping up hair comprising: a bob member for being attached to the back of the hair; a comb affixed to the bob member for supporting the bob member and means for locking the bob in place.

DETAILED DESCRIPTION OF THE INVENTION

Figure 1:
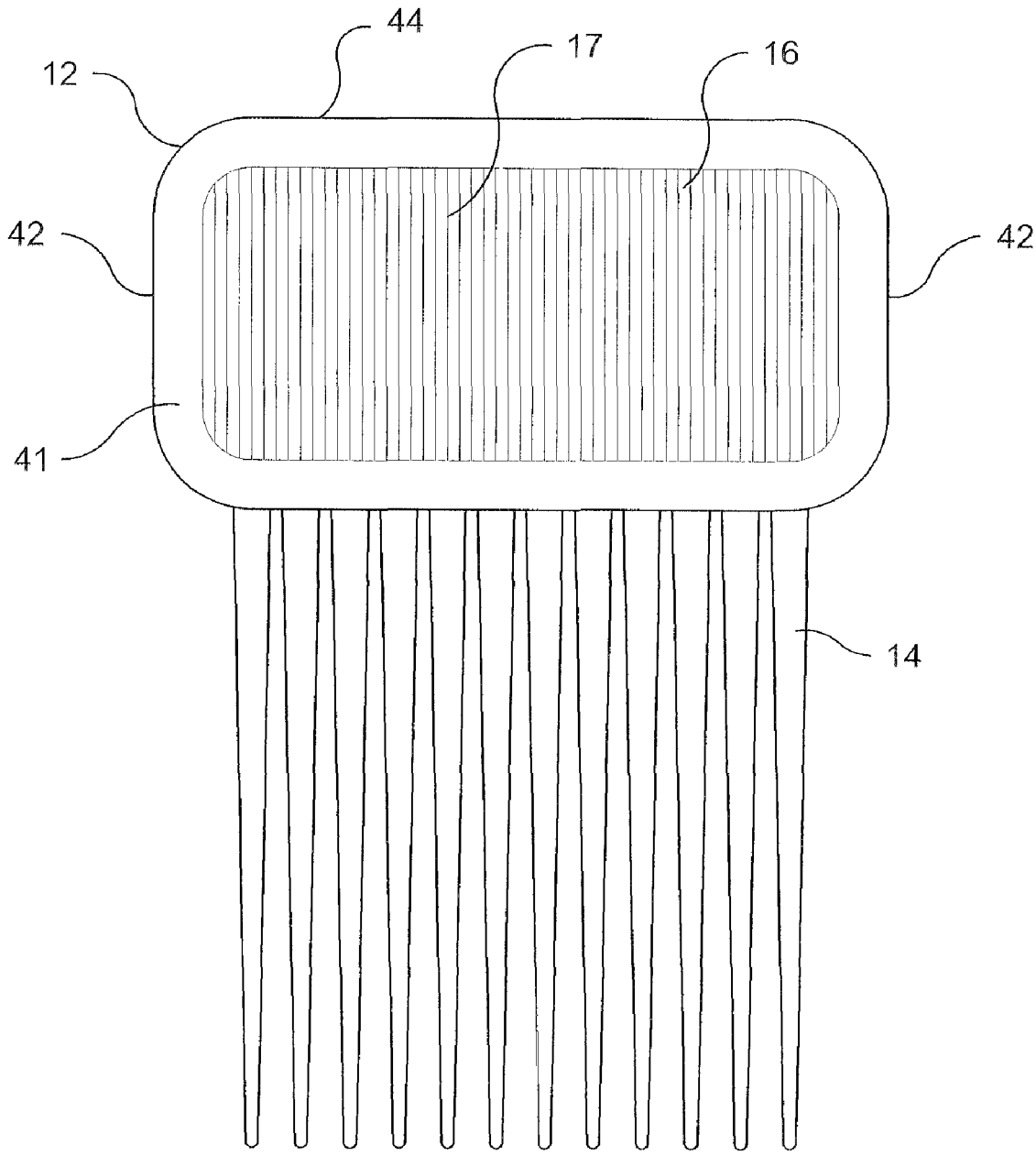
FIG. 1 is a schematic top view of an embodiment of the hair enhancing apparatus of the present invention.
Figure 2:
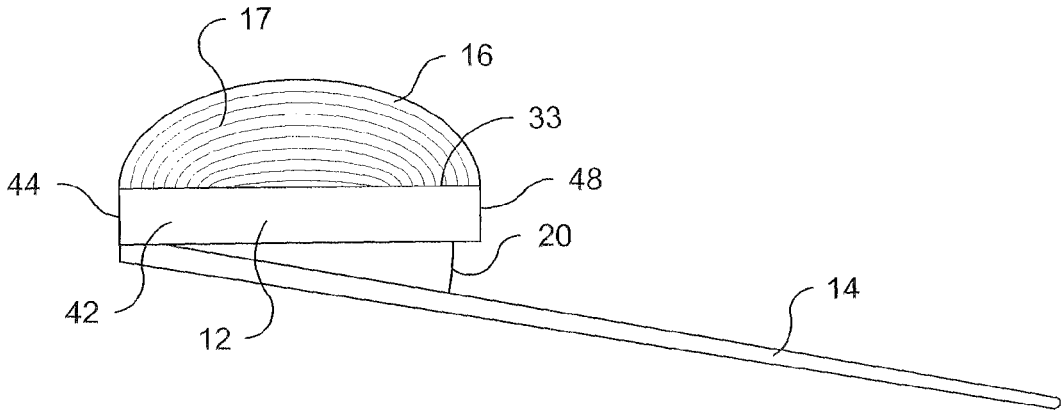
FIGS. 2 and 3 are schematic side views of another embodiment of the hair enhancing apparatus in which the clamp is in open and closed positions, respectively.
Figure 3:
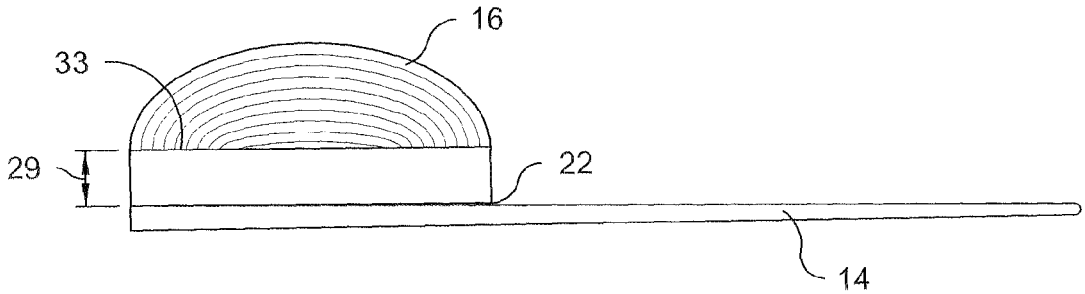

The present invention is described with reference to the enclosed Figures wherein the same numbers are used for like parts. Referring to FIG. 1, the hair enhancing apparatus of the present invention is shown to comprise a bob member 12 attached to a comb comprising a plurality of comb members 14. Referring to FIGS. 2 and 3, the bob member 12 comprises a shaped member 16 (occasionally referred to herein as the "top") of colored human or synthetic hair 17 which is held in place by means of a cloth strap represented schematically by line 33. The bob member has a height 29 of approximately ⅜ to ½ inch. This is most clearly shown in FIG. 3.

Figure 4:
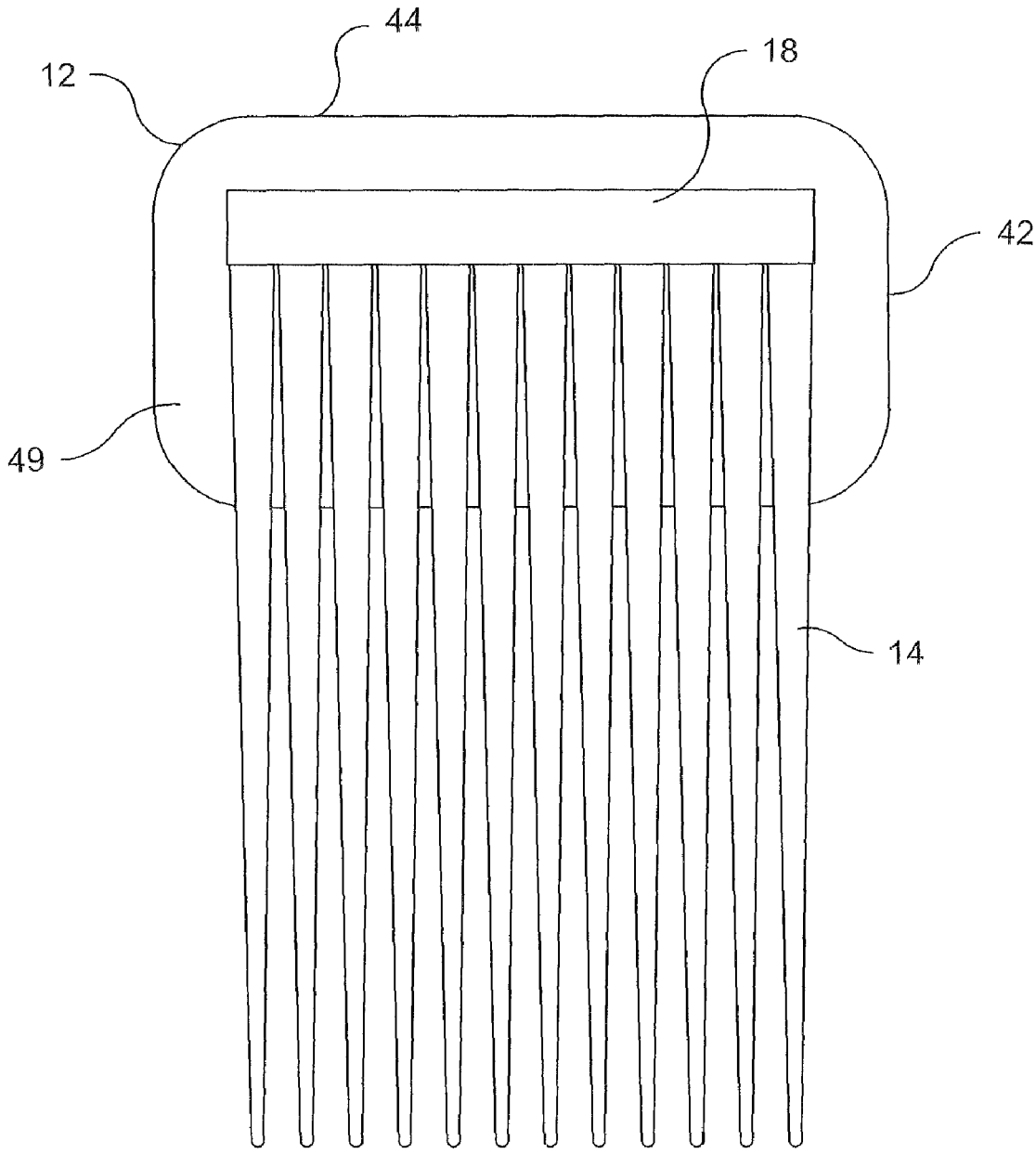
FIG. 4 is a schematic bottom view of the hair enhancing apparatus of FIG. 1.
Figure 5:
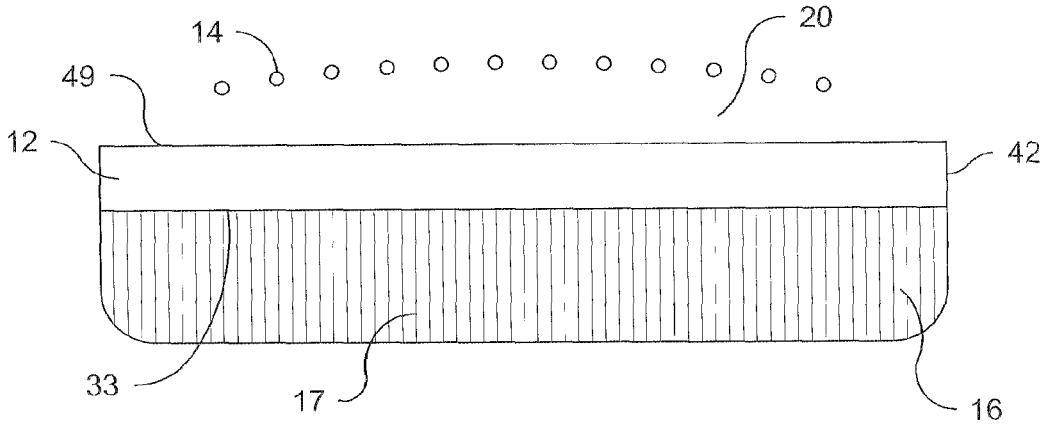
FIGS. 5 and 6 are schematic inverted front views of the hair enhancing apparatus of FIGS. 2 and 3, respectively, in which the clamp is in open and closed positions.
Figure 6:
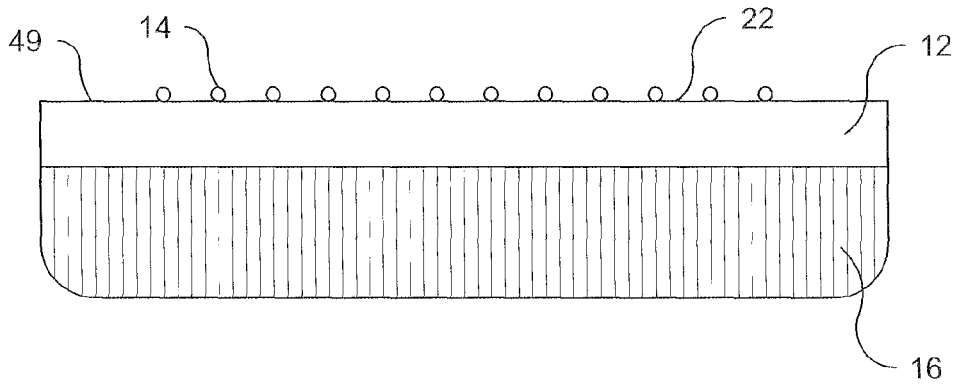

Referring to FIG. 4, the base 49 of the bob member is affixed to a clamp in the form of a metallic clip 18 with extending comb members 14. Referring to FIGS. 2, 3, 5 and 6, the clip is bendable to conform to both an open snap position 20 and closed snap position 22.

The following naming convention has been adopted to identify elements of the hair enhancing apparatus with clarity. The lower portion of the bob member 12 has a substantially bulky rectangular block shape with substantially planar faces. The "upper face" of this block is 41 (FIG. 1). The "front face" 48 (FIG. 7) of the lower portion faces the direction of the extending comb members 14. Opposite front face 48 is the "rear face" 44 (FIG. 1). Other faces of the lower portion are opposite "sides" 42. Preferably, the front face 48 and rear face 44 are substantially the same length, the two sides 42 are substantially the same length, and the sides are smaller than the front face and rear face. The base 49 (FIG. 4) for the bob member 12 is the underside of the lower portion.

Figure 7:
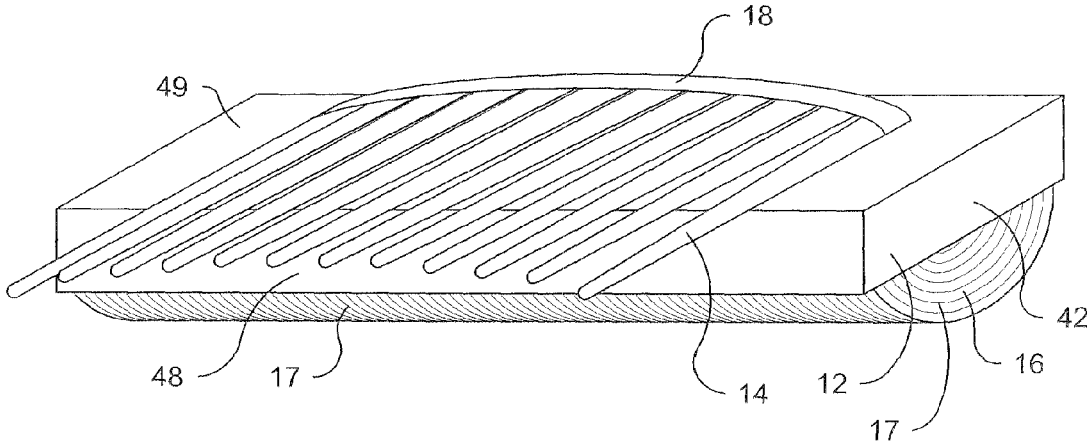
FIG. 7 is a perspective view of the embodiment of the hair enhancing apparatus of FIG. 1.

Shaped member 16 is positioned adjacent the upper face 41. FIGS. 1 and 7, illustrate an embodiment of the hair enhancing apparatus in which the area of contact of the top 16 and the lower portion of the bob member 12 is less than the area of the upper face 41. The top 16 and upper face 41 are congruent in the embodiment shown in FIGS. 2, 3, 5 and 6. Also in the embodiment of FIGS. 2, 3, 5 and 6, the clip 18 is positioned flush with the rear face 44. In another embodiment the clip 18 is spaced away from the rear face 44 as shown in FIGS. 4 and 7.

Figure 8:
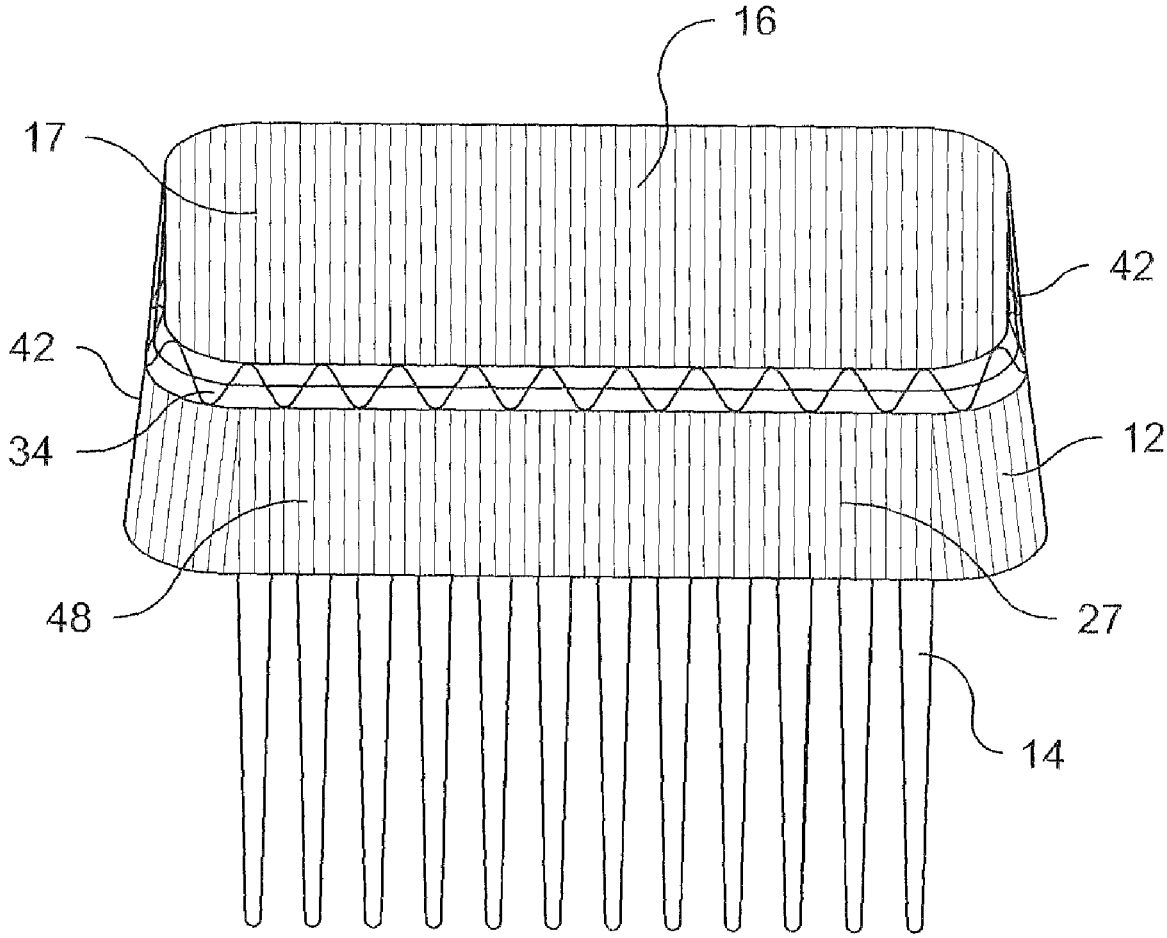
FIG. 8 is a front perspective view of another embodiment according to the present invention.

Preferably the hair 17 covers the outer surface of shaped member 16. As shown in the Figures, the filaments of hair 17 render the top convexly curved and protruding upward from the upper face. More specifically, a plurality of filaments of the human or synthetic hair 17 are arranged in substantially parallel arches fixed at both ends to the bob member. The arches span from the rear face to the front face. Strap 33 extending around the bob member near the top holds the arched fibers in place. FIG. 8 shows a perspective view of an embodiment according to this invention which includes a strap 34. In this embodiment the filaments 17 are arched over the top from rear to front, and continue under the strap 34 to form substantially parallel filament extensions 27. The array of filament extensions 27 cover the front face of the bob member 12.

In a first position 20 of clip 18, the comb members, that is, the teeth of the comb are extended outward away from the base of the bob member. This enables the hair enhancing apparatus to be placed in the hair of the user. When the clip is pushed to the second locking position, 22 the teeth of the comb move inward thus securing the wearer's hair between the base 49 and the comb members 14. The bob member then props up the hair of the user.

The bob member 12 props up the user's hair and provides the illusion of increased hair height. It is to be appreciated that the bob member of the present invention is specifically designed to match the color requirements with a multitude of wearers. Thus, the bob member can be in brown, black, red, silver color or any combination therof.

The critical advantage of the hair enhancing apparatus is that it achieves the result without messy or hot synthetic hair pieces or falls and without the need for chemical agents and sprays. The present invention can include a kit with multiple hair enhancing apparatus, specifically shaped bob members and teasing combs.

The operation of the invention is as follows: First, a small section of hair (about ¾ of an inch thick) is held away from the scalp and held straight up firmly. A teasing comb is inserted from the back, teeth facing forward into the lifted hair approximately 1½ inches above the scalp. The comb is slid down toward the scalp.

After the teased hair is moved forward, the comb members 14 of a hair enhancing apparatus are placed into the crown area (area at the top of the head between the ears). The hair enhancing apparatus is attached about ¼ of an inch up into teased hair, with the attached clip. The snap clip is closed to lock the hair enhancing apparatus into the hair securely. Once the hair enhancing apparatus is secure, the hair is flipped over the apparatus to cover the bob member 12. The hair is combed and sprayed for extra hold.

The present invention has been described with referenced to the enclosed figures. It is to be appreciated that the true nature and scope of the present invention is to be determined with reference to the claims appended hereto.

The invention claimed is:

1. A hair enhancing apparatus for propping up hair comprising:

a bob member for being attached to the back of the hair;

a comb affixed to said bob member for supporting the bob member; and a clamp which provides a means for clamping the hair and locking it in place for use in which the bob member has (i) a substantially flat, rectangular base defining a base plane, (ii) substantially flat sides each defining a side plane positioned peripheral to the base and oriented at a substantially right angle to the base plane, thereby forming a shape of a substantially bulky, rectangular block, and (iii) a convexly curved top protruding upward from the sides opposite the base wherein one side of the bob member defines a front face, a second side of the bob defines a rear face opposite the front face, and in which the top comprises a plurality of filaments of human or synthetic hair arranged in substantially parallel arches fixed at both ends to the bob member and spanning from the rear face to the front face.

2. The hair enhancing apparatus of claim 1 which further comprises a strap extending across the front face proximate to the top and oriented substantially parallel to the base plane.

3. The hair enhancing apparatus of claim 2 in which the filaments are held in place by the strap.

4. The hair enhancing apparatus of claim 3 in which the bob member defines a height from the base to the top of about ⅜ to about ½ inch.

5. The hair enhancing apparatus of claim 1 in which the comb is affixed to the base and comprises a plurality of comb members protruding outboard of the bob member from the front face, the comb members having tips distal from the bob member.

6. The hair enhancing apparatus of claim 5 in which the comb has a comb edge opposite the tips which is affixed to the base of the bob member by the clamp.

7. The hair enhancing apparatus of claim 6 in which the clamp is a snap clip bendable to provide an open position and a closed position.

8. The hair enhancing apparatus of claim 7 in which the open position of the clip defines a location of the comb members away from the base of the bob member, such that a gap exists between the comb members and the base, and in which the closed position of the clip defines a location of the comb members in contact with the base, such that the gap is eliminated.

9. The hair enhancing apparatus of claim 8 in which the clamp is operative to lock the hair enhancing apparatus in position on a human head by placement of the hair enhancing apparatus such that hair of the head enters the gap while the clip is in the open position and said hair is secured against the bob member when the clip is in the closed position.

10. A hair enhancing apparatus for propping up a wearer's hair comprising:

a bulky block having a rectangular base, sides substantially perpendicular to the base, and a convexly curved top, in which colored human or synthetic hair filaments are attached to an outer surface of the block and top, a comb affixed to the base and comprising a plurality of comb members protruding outboard of the base, the comb members having tips distal from the block, and clamp means affixed to the base for removably attaching the apparatus to the wearer's hair by grasping and releasing the wearer's hair between the base and comb, in which the apparatus is free of a hair piece of multiple hair filaments attached to the hair piece by only one end of each hair filament.

11. A method of styling a person's hair comprising the steps of (A) providing a hair enhancing apparatus for propping up hair as recited in claim 1, (B) lifting a group of the person's hairs up straight from the scalp, (C) while the hairs are lifted, teasing the hairs with a comb, and then inserting protruding comb members of the hair enhancing apparatus forward into one side of the group of the person's teased hairs, and sliding the hair enhancing apparatus down the lifted hairs such that the base of the apparatus contacts the person's scalp, (D) while maintaining the apparatus in contact with the person's scalp, activating the clamping means to affix the apparatus to the person's hair, and (E) combing the person's hairs rearward over the top of the hair enhancing apparatus and thereby covering the hair enhancing apparatus and puffing up the person's hair above the hair enhancing apparatus.

* * * * *